United States Patent [19]

Garrett

[11] 4,449,897

[45] May 22, 1984

[54] SINGLE-ACTING PISTON PUMP HAVING TWO HEADS

[76] Inventor: William R. Garrett, 24 Palmer Dr., Conroe, Tex. 77302

[21] Appl. No.: 304,828

[22] Filed: Sep. 21, 1981

[51] Int. Cl.[3] ..... F04B 39/00

[52] U.S. Cl. ..... 417/437; 92/86.5

[58] Field of Search ..... 417/437, 900; 92/86.5

[56] References Cited

U.S. PATENT DOCUMENTS

| | | | |
|---|---|---|---|
| 1,647,425 | 11/1927 | Wise . | |
| 1,768,633 | 7/1930 | Ries . | |
| 1,774,967 | 9/1930 | Ellis . | |
| 1,792,646 | 2/1931 | Leonard . | |
| 1,818,187 | 8/1931 | Bailey . | |
| 1,964,932 | 7/1934 | Stoesling et al. . | |
| 2,188,105 | 1/1940 | Caldwell . | |
| 2,315,012 | 3/1943 | Park . | |
| 2,367,185 | 1/1945 | Cary . | |
| 2,545,506 | 3/1951 | Walsh . | |
| 2,677,581 | 5/1954 | Taylor . | |
| 2,827,860 | 3/1958 | Roberts . | |
| 2,858,767 | 11/1958 | Smith . | |
| 3,104,619 | 9/1963 | Swarthout . | |
| 3,146,940 | 9/1964 | McCrory et al. | 92/86.5 |
| 3,256,827 | 6/1966 | Smith | 417/900 |
| 3,279,383 | 10/1966 | Smith . | |
| 3,295,452 | 1/1967 | Smith | 417/900 |
| 3,720,140 | 3/1973 | Lee . | |
| 3,818,807 | 6/1974 | Semple . | |
| 4,023,469 | 5/1977 | Miller . | |
| 4,157,057 | 6/1979 | Bailey . | |

*Primary Examiner*—William L. Freeh

*Attorney, Agent, or Firm*—Vaden, Eickenroht, Thompson, Bednar & Jamison

[57] ABSTRACT

A single-acting piston pump for output connection to a high pressure manifold and to an input of slush or slurry. The forward head of the piston pump is mounted for contact with the slush or slurry. In one embodiment, this forward head of the piston pump is mounted to the piston rod so as to be movable within limits, its rearward movement with respect to the piston rod opening a biased-closed valve either through the shaft of the piston or through a fixed rearward piston head. This valve opening leads to a clean fluid source at a pressure only slightly less than the high pressure manifold. There is a recess opening between the movable head and the piston shaft and in front of the fixed head in which clean fluid is always present. The movable head operates at a low pressure differential on both the forward and rearward movement of the piston stroke and the fixed head operates at all time in a clean fluid environment. Another embodiment includes two fixed heads and regulating means having a regulator connected between the working chamber of the main pump and a controlled clean fluid source for providing through a port in the rearward piston head low differential pressure to the forward head and a clean fluid environment to the rearward head.

14 Claims, 6 Drawing Figures

FIG. 1
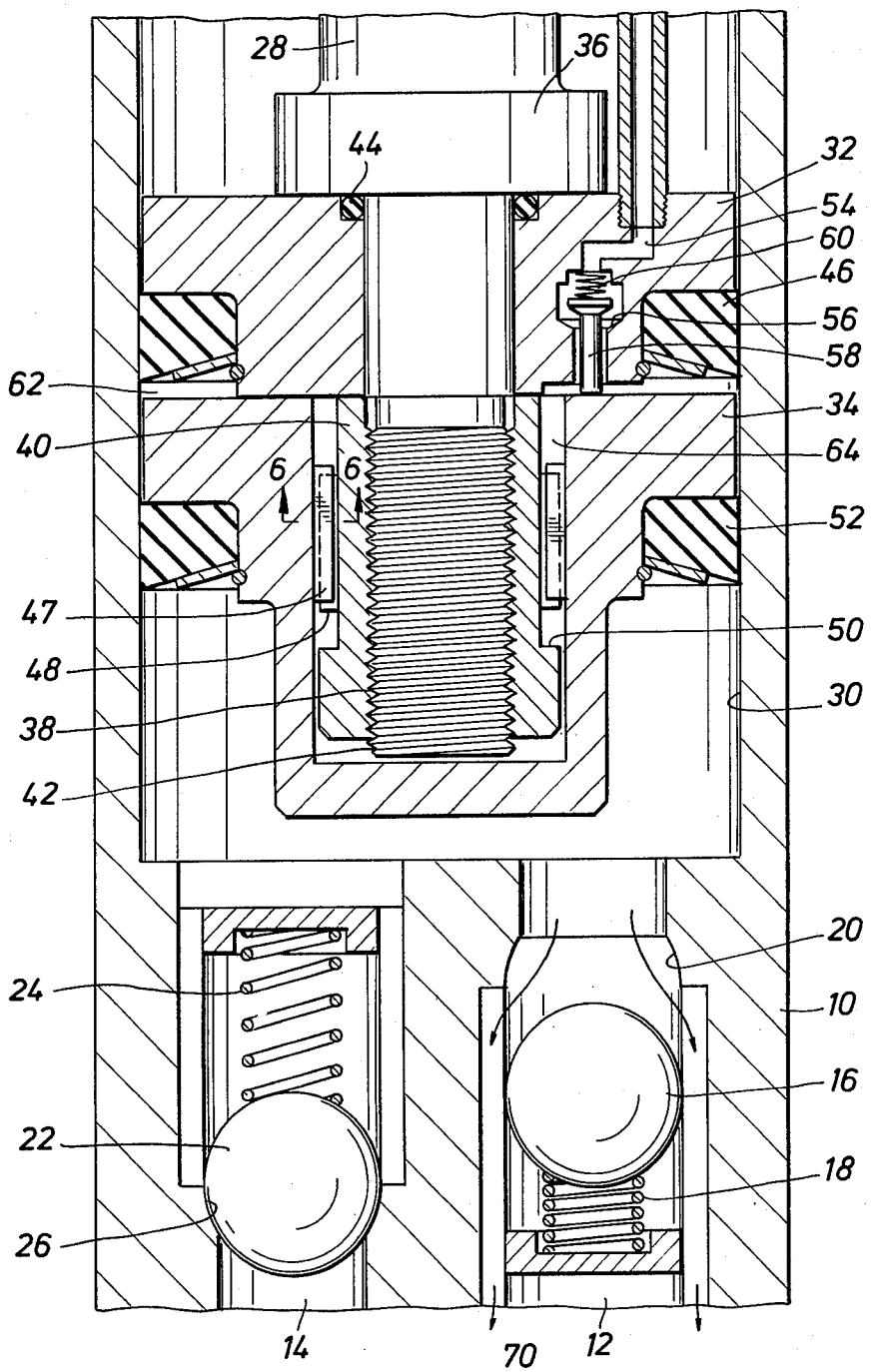
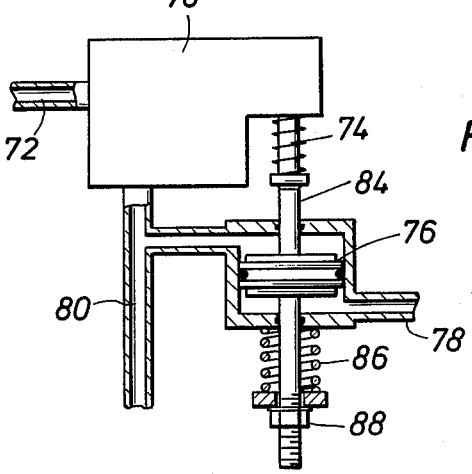
FIG. 3
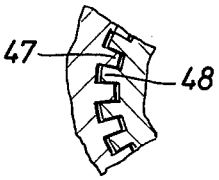
FIG. 6

SINGLE-ACTING PISTON PUMP HAVING TWO HEADS

BACKGROUND OF THE INVENTION

1. Field of the Invention

This invention pertains to a piston pump useful for operating in an environment of slush or slurry and more specifically to such a single-acting piston pump utilizing two heads each in sealing engagement and operation with the inside bore of the chamber or cylinder of the pump.

2. Description of the Prior Art

Slushes and slurry, such as in an oil well bore application or in a coal pipe line application, include extremely abrasive materials requiring the use of an elastomeric seal at the piston head. Even so, such abrasiveness quickly wears out piston pump seal parts and cylinders that operate in conjunction therewith.

Moreover, such pumps commonly work in environments commonly in excess of 1000 psi. Hence, for a piston pump seal parts that may last 2000–3000 hours at a few hundred psi, such parts last only between 500–1000 hours when operated at 3500 psi, all other conditions remaining the same. In addition, it is known that pump piston seals and cylinders have a longer life, even at high pressures, if the fluid with which they operate is lubricous and free of abrasive particles.

In brief, the seals and bores of cylinders on a piston wear out quickly when (1) the fluid is abrasive or of low lubricity, and (2) the operating conditions are at high pressure. Life of the seal parts is extendable, therefore, by making cleaner or more lubricous the fluid in which high operating pressure occurs and/or by reducing the operating pressure in which the movable seal parts operate.

Prior art piston pumps have focused on improving the seal material, establishing duplex and even triplex operation of the parts to reduce the wear on the sealing parts. Prior art solution attempts have been expensive and/or more complex than the solution to the above problems solved by the embodiments of the present invention.

Therefore, it is a feature of the present invention to provide an improved piston pump providing a more clean and lubricous environment for one of the chief operating high pressure seal parts than provided in the prior art.

It is another feature of the present invention to provide an improved piston pump which provides a reduced pressure environment for another of the chief operating seal part, which part is subjected to the abrasive slush in the piston chamber.

SUMMARY OF THE INVENTION

The piston pump embodiments of the invention disclosed herein include two pump heads, each with seals operating along the wall of the chamber of the cylinder. There is an oil or fixed head which is fixedly attached to the piston rod and there is a slush head working in the chamber in which the slush or slurry is introduced. In two of the described embodiments, the slush head is longitudinally movable within limits with respect to the piston rod passing through the first head. A valve-operated discharge opening leading to a discharge manifold and a valve-operated intake opening is connected to the chamber. A biased-closed, valve-operated clean fluid port communicates a pressurized source of clean fluid to the front side of the oil head so that it always operates in a clean environment. The fluid port valve is pushed open when the piston moves forward to open the high pressure discharge opening, thereby placing high pressure, with only a slight pressure differential therebetween, on both sides of the slush head. The fluid port valve closes when the piston is retracted, thereby closing the discharge opening and opening the low-pressure intake opening, thereby placing low pressure, with only a slight pressure differential therebetween, on both sides of the slush head.

A regulator connected to a source of clean fluid includes a regulator piston with one side connected to the discharge manifold and the other side connected to the output of a clean fluid pump as well as the fluid port valve just described. The regulator piston also operates to turn on a biased-off switch on the fluid pump. When the pressure differential is too great between the two sides of the regulator piston, the switch on the pump is turned on until the pressure differential is reduced.

A second embodiment of the main two-seal pump includes two fixed piston heads, one operating in a clean fluid environment via a port therethrough and the other operating with the slush. A regulator piston is connected on one side to a controlled clean fluid source and the port passing through the first head and on the other side to the slush chamber. Again, a pressure differential, across the regulator piston which exceeds a predetermined value causes the clean fluid source to come up to pressure to shut the regulator off. This maintains a low pressure differential across the slush head.

BRIEF DESCRIPTION OF THE DRAWINGS

So that the manner in which the above-rectied features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope, for the invention may admit to other equally effective embodiments.

IN THE DRAWINGS

FIG. 1 is a cross-sectional view of a pump piston and related cylinder in accordance with a preferred embodiment of the present invention, the piston being shown on the forward portion of its stroke.

Figure 2:
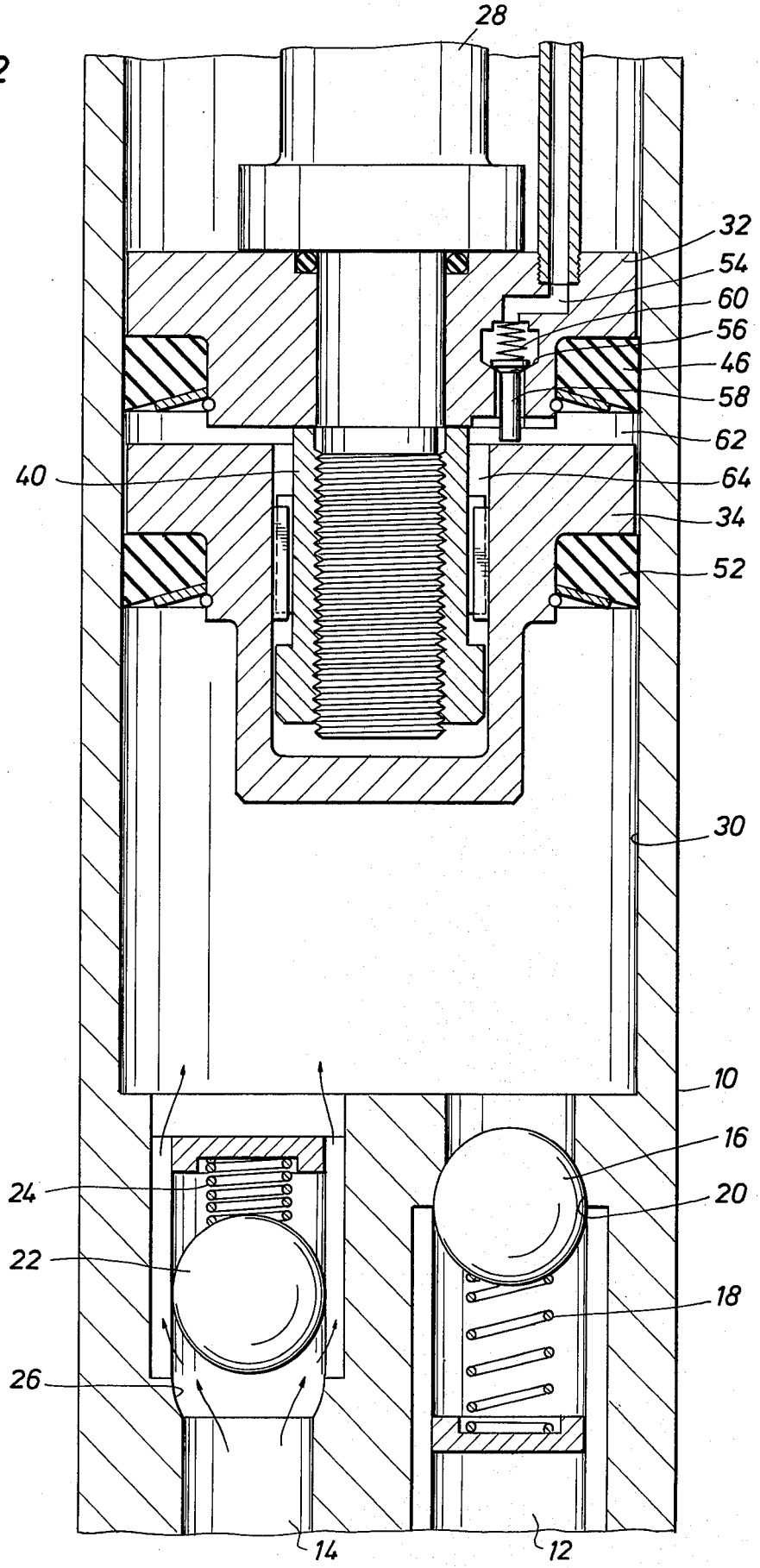

FIG. 2 is a cross-sectional view of the pump piston and related cylinder shown in FIG. 1 with the piston being shown on the suction portion of its stroke.

FIG. 3 is a cross-sectional view of a preferred embodiment of a fluid pump regulator useful in conjunction with the pump piston shown in FIGS. 1–2.

Figure 4:
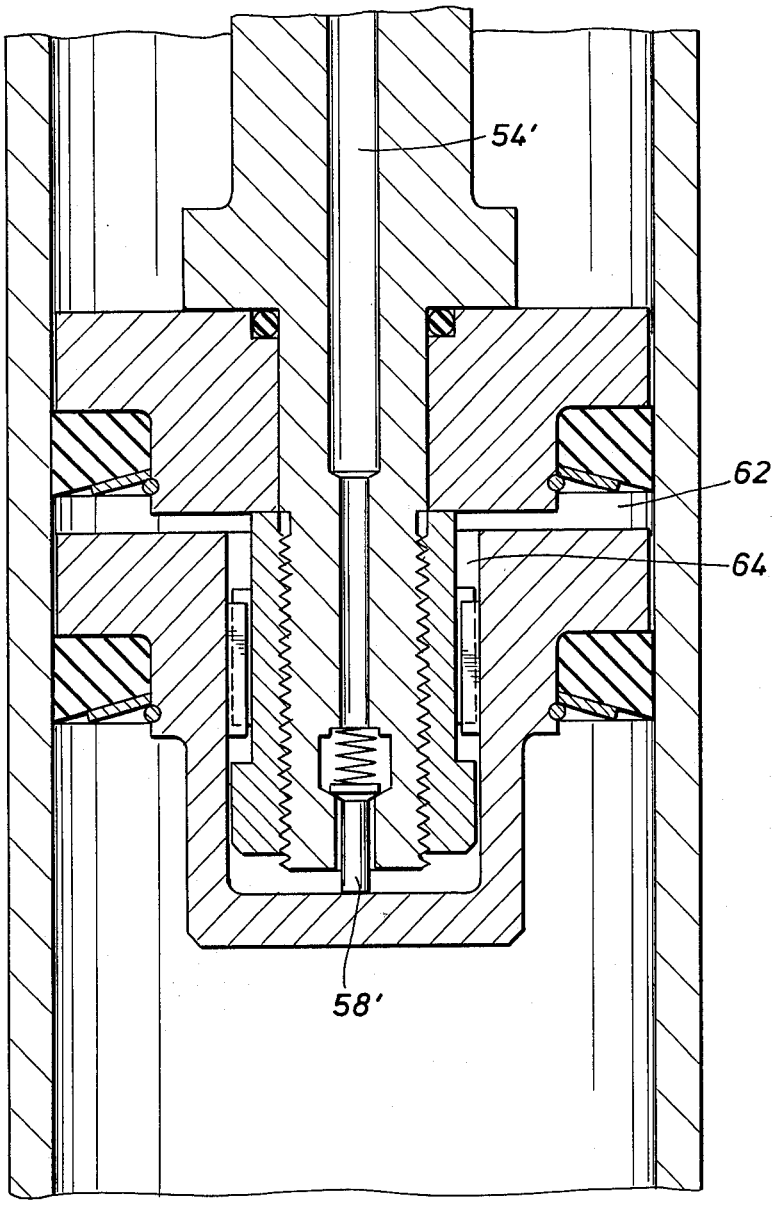

FIG. 4 is a partial cross-sectional view of an alternative preferred embodiment of a pump piston and related cylinder in accordance with the present invention.

Figure 5:
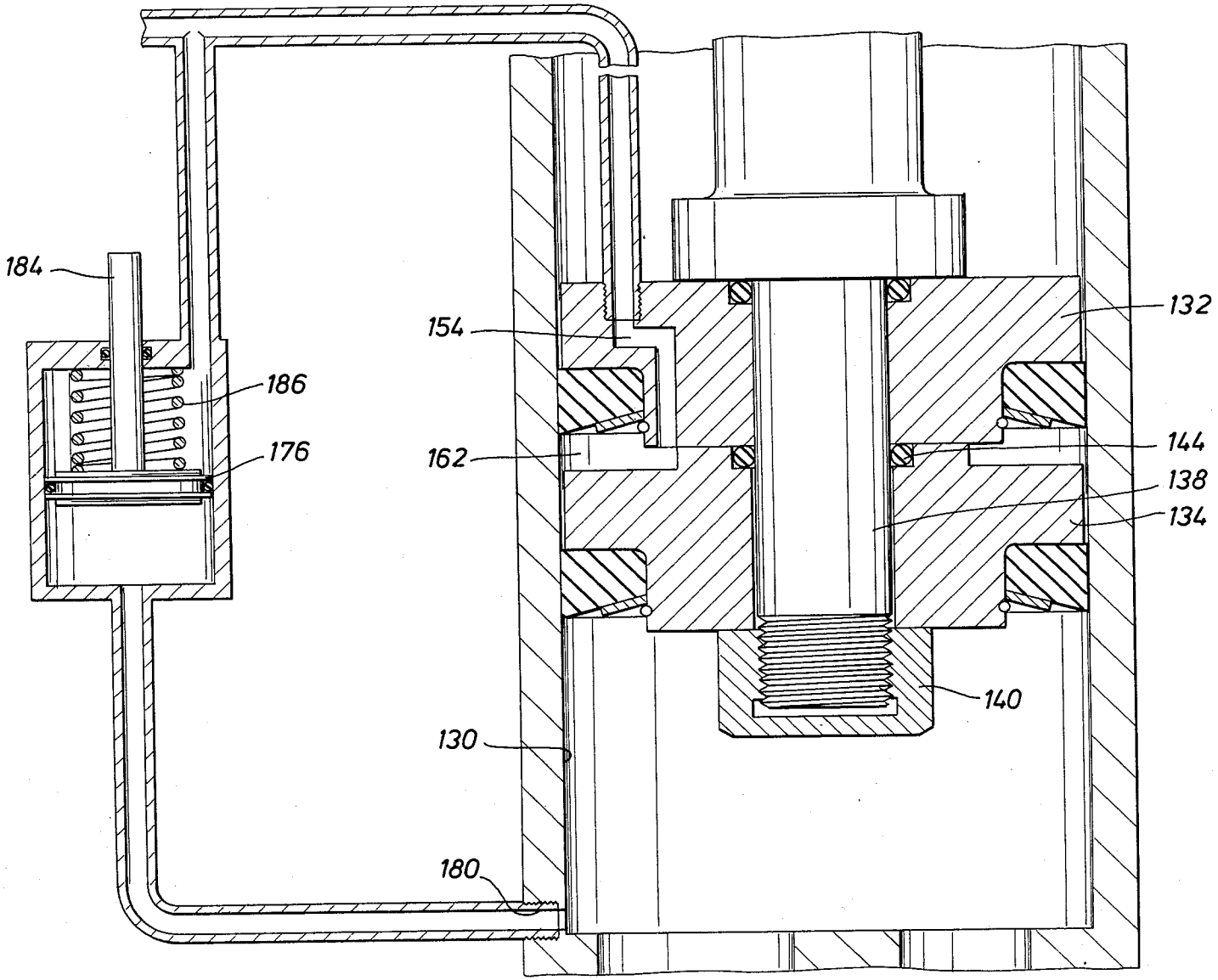

FIG. 5 is a partial cross-sectional view of yet another alternative preferred embodiment of a pump piston and related cylinder and related regulator piston in accordance with the present invention.

FIG. 6 is a partial cross sectional view taken at section 6—6 of FIG. 1.

DESCRIPTION OF PREFERRED EMBODIMENTS

Now referring to the drawings in first FIG. 1, a cross-sectional view of a preferred embodiment of the piston pump in accordance with the present invention is shown. Cylinder or chamber 10 is shown with the discharge opening 12 of the manifold leading to a high pressure circulating system (not shown) and an intake or inlet opening 14 which is connected to a reservoir of slush or slurry with which the piston pump operates. These openings are connected at the bottom of the cylinder as presented on the page. In an actual installation, the cylinder is normally operated horizontally rather than in the vertical direction, however.

For illustrative purposes, both valve arrangements that are shown operating respectively in the discharge opening and the intake opening are ball valves, although other valve arrangements are perfectly suitable. Discharge opening includes a ball 16 which is biased away from the high pressure circulating system by spring 18 toward valve seat 20. Intake valve opening is closed by ball 22, which is biased away from the operating or working chamber of the pump by spring 24 and toward valve seat 26. In FIG. 1, it will be seen that the valve in the discharge opening is illustrated in the open position and the valve in the intake opening is illustrated in the closed position.

Piston rod 28 reciprocates forward and rearward within the bore or liner 30 of cylinder 10 carrying with it piston heads 32 and 34 which are described more fully hereinafter. Piston rod 28 includes at a location next to head 32 an enlargement 36 and forward thereto, an externally threaded projecting end 38. Piston head 32 includes a central opening which slides over projecting end 38 to rest against the shoulder of enlargement 36. A internally threaded piston cap or nut 40 is screwed over the mating screw threads of projection 38 to fixedly secure piston head 32 in the position shown. In the embodiment shown, it may may be noted that the threaded opening of cap 40 passes all the way therethrough so that the tip end of projection 38 extends slightly forward of cap 40 at extension 42. However, this is not necessary to make an operable embodiment; however, it emphasizes the existence of a recess for fluid between cap 40 and head 34. O-rings 44 insure a fluid seal between the piston rod shoulder at enlargement 36 and piston head 32.

A forward circumferential seal 46 is mounted via a plate and snap rings within fixed piston head 32 to form a forward seal of the head with respect to the internal wall of the chamber bore in which it operates, the seal being slightly greater in circumference than the head 32 of which it is a part.

Head 34 is movably mounted with respect to the piston rod by having an internal cup-like chamber which fits over cap 40. The internal surface of the piston head includes guides 47 which operate in conjunction with accommodating guides 48 on the external surface of the piston rod cap. By referring to FIG. 6, it may be seen that these guides are actually in the form of mutually coacting splines which provide torque means for tightening cap 40 into place and for removing cap 40 when desired.

The cap also includes a forward limit shoulder 50 for contacting guides 47 of the head when the piston head is at its most forward position. The head is limited in its rearward position by coming in contact with fixed head 32. Therefore, it will be seen that piston head 34 is movable with respect to piston rod 28, but within limits.

Piston head 34 includes seals 52, which are similar to seals 46 of head 32 in that they are similarly mounted and they make contact with the internal surface of bore 30 of the working chamber and are slighly larger in circumference than the head to which they are attached. The seals may be attached to their respective heads by various means; however, as mentioned above slip rings and a mounting plate for this purpose are illustrated in the drawings.

Head 32 also includes a port 54 connected to a source of pressurized fluid (not shown in FIG. 1 but illustrated as a pipe 80 in FIG. 3), the port including a forward valve seat 56 in which a plunger valve 58 operates. Plunger valve 58 is biased downwardly or forwardly by spring 60 and projects slightly forward of head 32 when the plunger valve is in its closed position. It may also be seen that there is a slight recess opening 62 at the periphery of piston head 32 in the vicinity of seal 46 to provide lubrication to the seal at all times, opening 62 communicating with port 54.

It should also be noted that recess 62 is in communication with opening 64 around cap 40 and internal to movable head 34. In fact, opening 64 communicates not only completely around the cap, but also around its end, since the parts are dimensioned so that even when the heads are in contact the opening remains. Alternatively, the end opening can be assured by the longitudinal amount of the forward end extension or projection 42, previously described.

FIG. 2 is an illustration of the cylinder shown in FIG. 1 wherein the piston rod is shown after some movement from its most forward condition toward retraction. Operation of the cylinder may be best explained by reference to both FIGS. 1 and 2 since normal operation progresses between the two conditions which are illustrated. When the cylinder moves forward from a retracted position, as shown in FIG. 1, discharge opening 12 is opened to discharge the contents in the chamber bore into the high pressure system to which it is connected and the suction valve in the intake opening is shut. It may be assumed that the discharge system is under a high fluid pressure condition of from 1000–5000 psi. Therefore, this pressure condition exists on the face of fluid seals 52 of the movable piston head.

When the movable head is moved back along the piston rod so that it contacts plunger 58, the valve operating in port 54 is opened and communicates through port 54 a high pressure source of clean fluid to the rear surface of head 34 and to the opening 64, which is also behind a portion of head 34. In actual practice, the relative backward movement of head may cause enough pressure in the fluid in recess 62 to open plunger 58 even before head 34 comes into contact therewith. It is preferred that the fluid pressure of the fluid in port 54 be approximately slightly less than the pressure of the fluid in the operating chamber. Therefore, when plunger 58 is opened, seal 52 operates at a low pressure differential and not under full discharge conditions. It may be observed that the circumference of the head is slightly less than the circumference of the seals, as fluid communicates with both the front and rear surfaces of seal 46. This is the condition which exists through the majority of the forward movement of piston 28.

When piston 28 is moved in a rearward direction, discharge ball valve 16 is seated to close off the high pressure connection to the chamber and intake or suction valve 22 is opened so that the chamber communicates with intake opening 14. The pipe to which intake 14 is connected is at a low pressure condition, either the head of the suction tank or from a low pressure supercharging pump. As soon as piston 28 moves a slight distance rearwardly, movable head 34 stays in its position while fixed head 32 is moved with the piston rod to the rearward position shown in FIG. 2. Since plunger 58 is biased forward, the valve portion thereof closes against valve seat 56, thereby closing the connection through port 54 to the source of the high pressure fluid. Of course, the fluid which was previously within opening 64 and recess 62 is still in place. However, the previous high pressure conditions no longer exist. Therefore, movable head 34 still operates within a pressure differential which is very slight between the front and rearward surfaces of the movable head. Hence, it may be seen that movable head 34 operates in both directions under low pressure conditions.

Now turning to the respective operating conditions of fixed head 32 and returning to FIG. 1, when plunger 58 is opened, clean fluid passes therethrough to the front of the piston to lubricate the surface of seal 46. It is presumed that clean fluid exists on the backside or rearward side of head 32. Therefore, during the forward movement of the piston, the seal of the fixed head is lubricated with clean fluid.

When plunger 58 moves forward and there is no longer communication to the fluid source during the retraction part of the piston cycle, the previously furnished clean fluid still exists in recess opening 62 and therefore applies clean fluid to seal 46, as well as to the rear side of head 34 and seal 52.

In summary, operation provides a low pressure differential to the movable piston head which is subjected to the abrasive slush during both forward and rearward movement of the piston. It applies a clean fluid environment to the fixed piston head which is subjected to high pressure on the forward stroke during both the forward and rearward portions of the cylce.

Reference is made now to FIG. 3, which shows a fluid pump regulator for operating in conjunction with the pump piston which has just been described. Pump 70 is a clean oil pump which is driven electrically, pneumatically or hydraulically with regard to an oil reservoir (not shown) or other source of clean fluid connected to input pipe 72. Switch 74 operates pump 70 and is biased downwardly by a spring or otherwise in the off position. Regulator piston 76 is connected so its upstream side is connected through pipe 78 to the high pressure discharge manifold which is connected to the downstream side of discharge opening 12 illustrated in FIGS. 1 and 2. The downstream side of regulator piston head 76 is connected to the discharge pipe 80 connected to pump 70 and to port 54 or 54'. A projection 84 connected to head 76 is positioned for unbiasing switch 74 when it moves upwardly and a regulator spring 86 is connected to a downward projection connected to regulator head 76 for multiplier bias control through an adjustment of bolt 88 operating on the threaded shaft around which spring 86 is wound.

In operation, regulator piston head 76 moves in the direction urged by whatever pressure differential exists between the fluids in pipes 78 and 80. In the position illustrated, it will be seen that the pressure is such that the switch 74 is biased fully off so that the pump is not running. When the pressure of the fluid in pipe 80 falls a bit, then the pressure in pipe 78 will move regulator head 76 upwardly so as to turn on switch 74 and build up the pressure in pipe 80. The build up of pressure will lower head 76 and turn off switch 74.

With respect to the operation of the pump piston described in FIGS. 1–2, it may be seen that the pressure of the fluid applied to port 54 is coordinated with respect to the high pressure output of discharge opening 12 and therefore the desired amount of pressure to the fluid therein is obtained at all times.

Now referring to FIG. 4, an alternate embodiment of the piston pump arrangement is shown. Essentially the only difference between the FIG. 4 embodiment and the previously discussed embodiment is that port 54' corresponding to port 54 described and illustrated in FIGS. 1 and 2, communicates through the rod shaft to the front of the fixed head, rather than through fixed head 32 itself. In this case, plunger 58' contacts the inside surface of the forward part of the movable head rather than the back surface. Please note that openings 62 and 64 are in communication in the same manner as with the first embodiment. Operation of the piston parts are substantially identical to that of the first embodiment.

Now referring to FIG. 5, an embodiment of the invention includes a first fixed head 132 mounted in the same manner as for the previously described embodiments. In this embodiment, however, a second or forward head 134 is likewise slipped over the end of forward projection 138 of the piston rod. O-rings 144 seal the connection between the piston heads at the shaft. The end of the piston rod is threaded for receiving cap nut 140 threaded thereover.

Head 132 is ported therethrough at port, which communicates to opening 162 on the rearward side of head 134. Port 154 communicates to the output side of a fluid source (not shown) similar to pump 70 illustrated in FIG. 3 and to the downstream side of regulator piston head 176. The upstream side of head 176 is connected through opening 180 to working chamber 130 of the main piston pump.

Rod 184 extends from regulator piston head 176 and is positioned to operate a biased off switch on the pump of clean fluid source, again similar to the FIG. 3 arrangement. A spring 186 can be included to assist the operation of piston 176. It should be noted that when a spring is added to the downstream side of a piston head, as shown, its bias impetus is added to the fluid pressure present on that side of the piston head to balance with the high pressure applied to the upstream side. That means that the downstream side pressure is slightly less than the upstream side pressure. Alternatively, the spring could be located to aid the upstream pressure side, thereby reversing the pressure difference that would exist therebetween.

In operation of the FIG. 5 embodiment, when the main piston rod opens the discharge outlet to the high pressure circulating system, then high pressure is present in chamber 130 and to the side of regulator piston head 176 connected thereto. This moves head 176 to open the clean fluid source by operating the pump therein and to build up pressure in the clean fluid part of the system. Therefore, a pressure only slightly less is applied to the forward head through port 154 in the rearward head. At the set condition, the pressure difference reduces to a value that shuts off the pump of clean fluid.

When the main piston pump rod starts on the rearward stroke, the high pressure discharge outlet is closed and the lower pressure intake opening is opened to the chamber. Regulator head 176 moves to relieve pressure on the clean fluid system until it again determines a slight pressure differential across head 134. At all times head 132 operates in a clean fluid environment.

It should be noted that any leakage of clean fluid is made up while the clean fluid pump is charging the system.

It should also be noted that the system is fully operable even without the presence of a spring 186 since there is a difference in area on the two sides of regulator piston head as determined by the size of rod 184 which subtracts from the area on the downstream side of this head.

Although several embodiments have been shown and described, it will be understood that the invention is not limited thereto since many modifications may be made and will become apparent to those skilled in the art. For example, the fluid differential across the slush piston has been described with respect certain typical pressures for an oil well bore application. The same principles are applicable, however, in other applications. Hence, typically the pressure differential will be set to be determined by the operating conditions.

What is claimed is:

1. A dual seal piston, comprising:

a first piston head for being affixedly secured to a piston rod for operating in a pump chamber and having a forward seal in contact with the wall of said chamber;

a second piston head for being secured to said piston rod and having a foward seal in contact with the wall of said chamber, there being a recess at least partially between said first piston head and said second piston head in communication with a port connectable to a clean and controlled pressure fluid source for providing clean fluid to the foward side of said first piston head and the rearward side of said second piston head;

a controlled pressure fluid source connecting: clean fluid to said port, said controlled fluid source including;

regulating means controlled by contact with said first piston head connected to the downstream side of said chamber for providing clean fluid from said source to the forward side of said first piston head at a small pressure differential with respect to the pressure in said chamber throughout the forward and rearward strokes of said piston.

2. A dual seal piston in accordance with claim 1, wherein said controlled high pressure fluid source includes a switch connected for turning on said source and providing clean fluid therefrom, said switch being biased in the off position, and wherein said regulating means includes a regulator piston head having a port for unbiasing said switch and turning on said source, the downstream side of said regulator piston head being connected to the output from said source and to said piston port, the upstream side of said regulator piston head being connected to the downstream side of said chamber, an upstream pressure on said regulator piston head greatly more than the downstream pressure thereon turning on said switch until the pressure differential therebetween reduces to a sufficiently small level to turn off said switch.

3. A dual seal piston in accordance with claim 1, and including biasing means connected to said regulating means for establishing said small pressure differential by controlling the on and off operation of said controlled high pressure fluid source.

4. A dual piston seal in accordance with claim 1, wherein said second piston head is forwardly and rearwardly slidable with respect to said piston rod, and wherein said second piston head is cup-shaped over the end of said piston rod, the internal surface of said second piston head including guides operating in conjunction with accommodating guides on external surface of said piston rod.

5. A dual seal piston in accordance with claim 4, wherein said piston rod includes a projection for limiting the forward position of said second piston head.

6. A dual piston seal in accordance with claim 1, wherein said second piston head is forwardly and rearwardly slidable with respect to said piston rod, wherein said piston rod is threaded beyond said first piston head for receiving a matingly threaded holding nut thereover, wherein said second piston head is cup-shaped over the end of said piston rod and said holding nut, and including torque engaging means between said holding nut and said second piston head to provide attachment and removal of said holding nut with respect to said piston rod.

7. A dual seal piston in accordance with claim 1, wherein said second piston head is forwardly and rearwardly slidable with respect to said piston rod, wherein said pump chamber is connected to a high pressure discharge manifold, and including a controlled high pressure source of clean fluid at a slightly lower pressure than the pressure of said discharge manifold, said port includes a valve seat, a fluid source plunger valve being biased forward and seated within said valve seat, to close said port, the plunger of said valve extending forward of said first piston head when said plunger valve is closed, the rearward position of said second piston head with respect to said rod opening said fluid source valve to connect clean high pressure fluid rearward of said movable piston head so that there is a small pressure differential thereon as said piston rod moves forward to open said discharge outlet to said high pressure discharge manifold, said first piston head being lubricated by the presence of clean fluid as it moves forward with said rod, the second piston head continuing forward at the reversal of said rod to close said fluid source valve and leave clean fluid behind said second piston head so that there is a small pressure differential on said second piston head between the pressure of said opened intake inlet and said residual fluid, said second piston head again moving rearwardly with respect to said rod to again open said fluid source valve.

8. A dual seal piston in accordance with claim 7, wherein said first piston head presents a shoulder to said second piston head in front of the exit of said port.

9. A dual seal piston in accordance with claim 7, wherein said first piston head portion of said piston includes said port.

10. A dual seal piston in accordance with claim 7, wherein a piston rod portion of said piston operating in front of said first head includes said port.

11. A dual seal piston pump in accordance with claim 7, wherein said clean and controlled high pressure fluid source includes a fluid pump regulator with a cylinder head, said regulator providing clean fluid from said source at a substantially constant pressure differential with respect to the pressure of said chamber.

12. A dual seal piston in accordance with claim 11, wherein said fluid source includes a switch biased in the off position for turning on said source and providing high pressure fluid from said source, and wherein said fluid pump regulator comprises a regulator piston head having a part for unbiasing said switch and turning on said source, the downstream side of said regulator piston head being connected to the output of said source, the upstream side of said regulator piston head being connected to said discharge manifold, manifold pressure greatly more than the pressure on the downstream side of said regulator piston head turning on said source until the pressure differential therebetween is predetermined sufficiently small.

13. A dual seal piston in accordance with claim 12, and including biasing means connected to said regulator piston for providing a multiplier regulator control.

14. A dual seal piston pump, comprising:

a chamber having on the downstream side thereof a discharge output connecting to a high pressure discharge manifold, and;

an intake inlet connectable to a low pressure reservoir;

a piston including a piston rod operating forward and rearward within said chamber;

a fluid discharge valve operating in conjunction with said discharge outlet and opening upon the forward stroke of said piston rod and closing on the rearward stroke of said piston rod;

a fluid intake valve operating in conjunction with said intake inlet and opening upon the rearward stroke of said piston rod and closing upon the forward stroke of said piston rod;

a first piston head affixedly secured to said piston rod and having a forward seal in contact with the wall of said chamber; and a second piston head secured to said piston rod and having a forward seal in contact with the wall of said chamber, there being a recess at least partially between said first piston head and said second piston head in communication with a port connectable to a clean and controlled high pressure fluid source for providing clean fluid to the forward said of said first piston head and the rearward side of said second piston head through regulating means controlled by contact with said first piston head.

* * * * *